US006015620A

United States Patent [19]

Schwarz, Jr.

[11] Patent Number: 6,015,620

[45] Date of Patent: Jan. 18, 2000

[54] COATED RECORDING SHEETS

[75] Inventor: William M. Schwarz, Jr., Webster, N.Y.

[73] Assignee: Xerox Corporation, Stamford, Conn.

[21] Appl. No.: 08/325,914

[22] Filed: Oct. 19, 1994

[51] Int. Cl.[7] ..... B41M 5/00

[52] U.S. Cl. ..... 428/411.1; 428/195; 428/211

[58] Field of Search ..... 428/195, 411.1, 428/211

[56] References Cited

U.S. PATENT DOCUMENTS 4,666,621 5/1987 Clark et al. ..... 252/91

*Primary Examiner*—Pamela R. Schwartz
*Attorney, Agent, or Firm*—Judith L. Byorick

[57] ABSTRACT

Disclosed is a recording sheet which comprises a substrate and a coating thereon comprising water and a surfactant capable of exhibiting a liquid crystalline phase in water at a temperature of about 25° C. or higher, said coating containing the water and surfactant in relative concentrations such that upon addition of water to the coating, the surfactant undergoes a phase change, thereby increasing the viscosity of the coating. In one embodiment, the surfactant is in a lamellar liquid crystalline phase and, upon addition of water to the coating, the surfactant undergoes a phase change to a hexagonal liquid crystalline phase. Also disclosed are ink jet printing processes wherein an aqueous ink is applied to the aforementioned recording sheet.

38 Claims, 3 Drawing Sheets

COATED RECORDING SHEETS

BACKGROUND OF THE INVENTION

The present invention is directed to recording sheets suitable for use in printing processes. More specifically, the present invention is directed to recording sheets which have been coated with a solution containing a surfactant in the lamellar phase, said recording sheets being particularly suitable for printing with aqueous ink compositions. One embodiment of the present invention is directed to a recording sheet which comprises a substrate and a coating thereon comprising water and a surfactant capable of exhibiting a liquid crystalline phase in water at a temperature of about 25° C. or higher, said coating containing the water and surfactant in relative concentrations such that upon addition of water to the coating, the surfactant undergoes a phase change, thereby increasing the viscosity of the coating. Another embodiment of the present invention is directed to a recording sheet which comprises a substrate and a surfactant which is $C_xH_{(2x+1)}(OCH_2CH_2)_yA$,

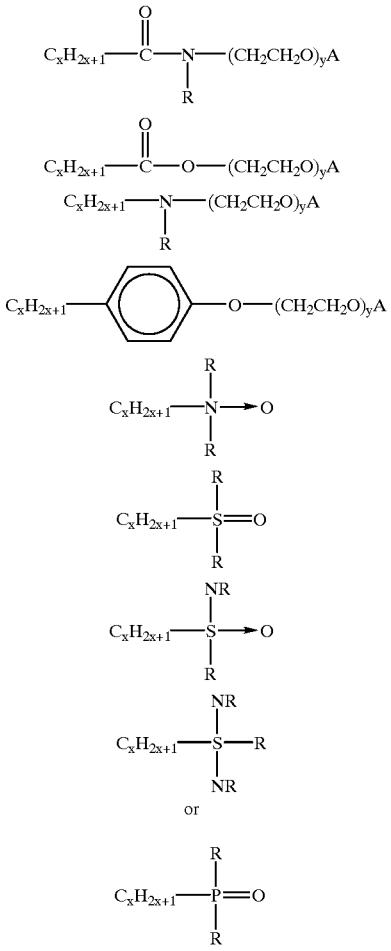

wherein x is an integer of from about 8 to about 22, y is an integer of from 0 to about 14, each R is, independently of the others, hydrogen or an alkyl group, and A is a terminal functional group. Yet another embodiment of the present invention is directed to a recording sheet which comprises a substrate and a coating thereon comprising a surfactant, said surfactant being in a lamellar liquid crystalline phase.

Ink jet printing systems generally are of two types continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. There are two types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

The other type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference.

U.S. Pat. No. 5,492,559, filed concurrently herewith, entitled "Liquid Crystalline Microemulsion Ink Compositions," with the named inventors John F. Oliver, Marcel P. Breton, Stig E. Friberg, Raymond W. Wong, and William M. Schwarz, the disclosure of which is totally incorporated herein by reference, discloses an ink composition which comprises an aqueous phase, an oil phase, an oil-soluble dye, and a surfactant, said ink exhibiting a liquid crystalline gel phase at a first temperature and a liquid microemulsion phase at a second temperature higher than the first temperature.

While known compositions and processes are suitable for their intended uses, a need remains for improved recording sheets suitable for use with aqueous recording inks. In addition, there is a need for recording sheets which, when employed with aqueous inks, exhibit images with sharp line edges and minimal line growth. Further, a need exists for recording sheets which, when employed with aqueous inks, exhibit acceptable dry times. Additionally, there is a need for recording sheets which exhibit reduced intercolor bleed when images of two different colors are printed in close proximity to each other. There is also a need for recording sheets which are particularly suitable for use in thermal ink jet printing processes. In addition, a need remains for recording sheets which, when employed in ink jet printing processes, exhibit little or no cockle or curl. Further, there is a need for transparent recording sheets suitable for ink jet printing processes wherein the ink exhibits little or no beading on the recording sheet and generates high quality images.

SUMMARY OF THE INVENTION

It is an object of the present invention to provide recording sheets with the above noted advantages.

It is another object of the present invention to provide improved recording sheets suitable for use with aqueous recording inks.

It is yet another object of the present invention to provide recording sheets which, when employed with aqueous inks, exhibit images with sharp line edges and minimal line growth.

It is still another object of the present invention to provide recording sheets which, when employed with aqueous inks, exhibit acceptable dry times.

Another object of the present invention is to provide recording sheets which exhibit reduced intercolor bleed when images of two different colors are printed in close proximity to each other.

Yet another object of the present invention is to provide recording sheets which are particularly suitable for use in thermal ink jet printing processes.

Still another object of the present Invention is to provide recording sheets which, when employed in ink jet printing processes, exhibit little or no cockle or curl.

It is another object of the present invention to provide transparent recording sheets suitable for ink jet printing processes wherein the ink exhibits little or no beading on the recording sheet and generates high quality images.

These and other objects of the present invention (or specific embodiments thereof) can be achieved by providing a recording sheet which comprises a substrate and a coating thereon comprising water and a surfactant capable of exhibiting a liquid crystalline phase in water at a temperature of about 25° C. or higher, said coating containing the water and surfactant in relative concentrations such that upon addition of water to the coating, the surfactant undergoes a phase change, thereby increasing the viscosity of the coating. Another embodiment of the present invention is directed to a recording sheet which comprises a substrate and a surfactant which is $C_xH_{(2x+1)}(OCH_2CH_2)_yA$,

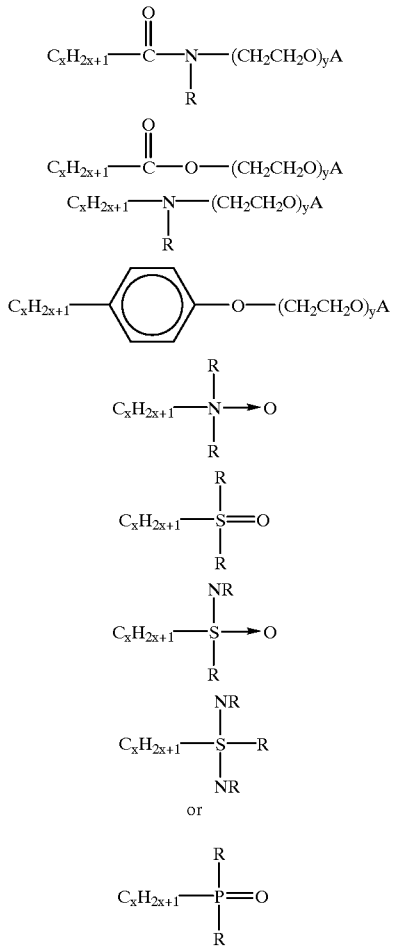

wherein wherein each R is, independently of the others, hydrogen or an alkyl group, x is an integer of from about 8 to about 22, y is an integer of from 0 to about 14, and A is a terminal functional group. Yet another embodiment of the present invention is directed to a recording sheet which comprises a substrate and a coating thereon comprising a surfactant, said surfactant being in a lamellar liquid crystalline phase.

DETAILED DESCRIPTION OF THE INVENTION

Figure 1:
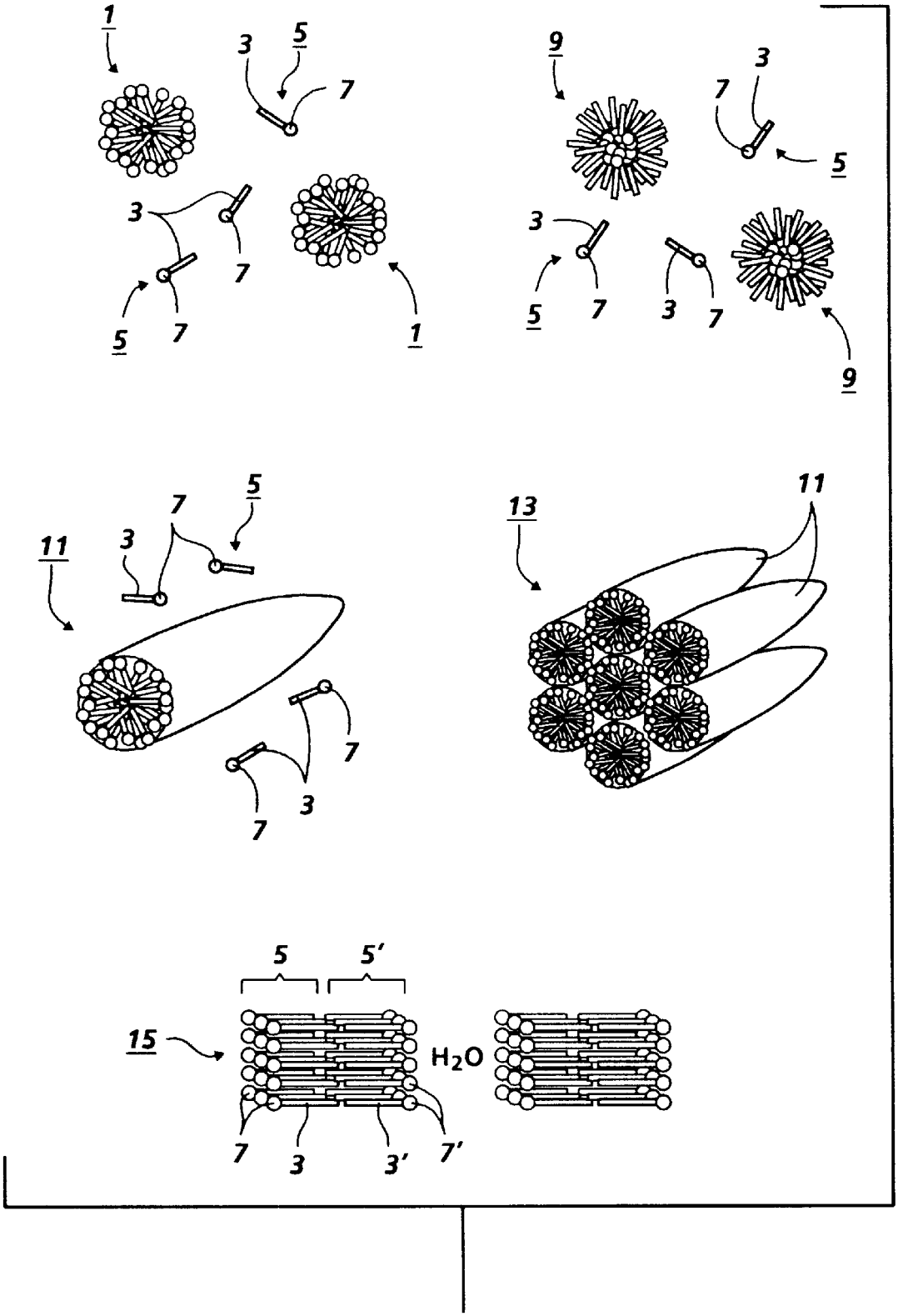
FIG. 1 illustrates schematically the various phase forms observed in an aqueous solvent by surfactant molecules suitable for coating the recording sheets of the present invention.

The recording sheets of the present invention comprise a substrate or base sheet and a surfactant. Any suitable substrate or base sheet can be employed. Examples include transparent materials, such as polyester, including Mylar™, available from E.I. Du Pont de Nemours & Company, Melinex™, available from Imperial Chemicals, Inc., Celanar™, available from Celanese Corporation, polyethylene naphthalates, such as Kaladex PEN films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate or base sheet comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates or base sheets suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate or base sheet can be of any effective thickness. Typical thicknesses for the substrate are from about 50 to about 500 microns, and preferably from about 100 to about 125 microns, although the thickness can be outside these ranges.

Situated on the substrate is a coating containing a surfactant capable of exhibiting a liquid crystalline phase in water at a temperature of about 25° C. or higher. The coating contains water and the surfactant in relative concentrations such that upon addition of water to the coating, the surfactant undergoes a phase change, thereby increasing the viscosity of the coating.

Surfactants suitable for the recording sheets of the present invention are those which are capable of forming liquid crystalline phases, such as hexagonal liquid crystalline phases and/or lamellar liquid crystalline phases, in solutions. Examples of suitable surfactants include those of the general structural formula $C_xH_{(2x+1)}(OCH_2CH_2)_yA$, wherein x is an integer of from about 8 to about 22, preferably from about 12 to about 18, y is an integer of from 0 to about 14, preferably from about 2 to about 8, and A is a terminal functional group. Also suitable are surfactants of the general structural formula

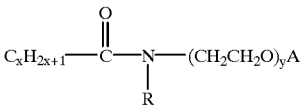

wherein R is hydrogen or an alkyl group (such as methyl, ethyl, propyl, butyl, or the like), x is an integer of from about 8 to about 22, preferably from about 12 to about 18, y is an integer of from 0 to about 14, preferably from about 2 to about 8, and A is a terminal functional group. Also suitable are surfactants of the general structural formula

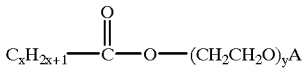

wherein x is an integer of from about 8 to about 22, preferably from about 12 to about 18, y is an integer of from 0 to about 14, preferably from about 2 to about 8, and A is a terminal functional group. Also suitable are surfactants of the general structural formula

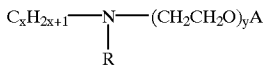

wherein R is hydrogen or an alkyl group (such as methyl, ethyl, propyl, butyl, or the like), x is an integer of from about 8 to about 22, preferably from about 12 to about 18, y is an integer of from 0 to about 14, preferably from about 2 to about 8, and A is a terminal functional group. Also suitable are surfactants of the general structural formula

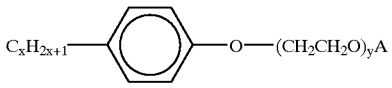

wherein x is an integer of from about 8 to about 22, preferably from about 12 to about 18, y is an integer of from 0 to about 14, preferably from about 2 to about 8, and A is a terminal functional group. Surfactants of this general formula are available from, for example, Union Carbide, Danbury, Conn. Also suitable are surfactants of the general formula

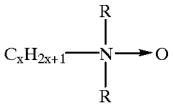

wherein each R is, independently of the other, hydrogen or an alkyl group (such as methyl, ethyl, propyl, butyl, or the like), and x is an integer of from about 8 to about 22, preferably from about 12 to about 18. Surfactants of this general formula are generally available, for example, as the Ammonyx Series from Stepan Chemicals, Northfield, Ill. Also suitable are surfactants of the general formula

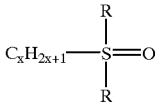

wherein each R is, independently of the other, hydrogen or an alkyl group (such as methyl, ethyl, propyl, butyl, or the like), and x is an integer of from about 8 to about 22, preferably from about 12 to about 18. Also suitable are surfactants of the general formula

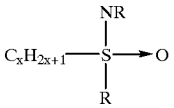

wherein each R is, independently of the other, hydrogen or an alkyl group (such as methyl, ethyl, propyl, butyl, or the like), and x is an integer of from about 8 to about 22, preferably from about 12 to about 18. Also suitable are surfactants of the general formula

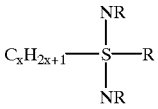

wherein each R is, independently of the others, hydrogen or an alkyl group (such as methyl, ethyl, propyl, butyl, or the like), and x is an integer of from about 8 to about 22, preferably from about 12 to about 18. Also suitable are surfactants of the general formula

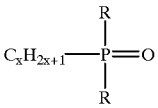

wherein each R is, independently of the others, hydrogen or an alkyl group (such as methyl, ethyl, propyl, butyl, or the like), and x is an integer of from about 8 to about 22, preferably from about 12 to about 18.

Examples of suitable terminal functional groups "A" include —H, —OH, —$CH_3$, —$C_2H_5$, —$CH_2CH_2CH_3$, —$CH(CH_3)_2$, —$OSO_3^-$, —$OSO_2NR_2$ wherein each R is, independently of the others, hydrogen or an alkyl group (such as methyl, ethyl, propyl, butyl, or the like), —$COO^-$, —$OPO_3^-$, —$C(O)OCH_2CH_2SO_3^-$, —$NR_3^+$ wherein each R is, independently of the others, hydrogen or an alkyl group (such as methyl, ethyl, propyl, butyl, or the like), —$N(R)CH_2COO^-$ wherein R is hydrogen or an alkyl group (such as methyl, ethyl, propyl, butyl, or the like), —$N^+R_2CH_2COO^-$ wherein each R is, independently of the other, hydrogen or an alkyl group (such as methyl, ethyl, propyl, butyl, or the like), —$N(R)CH_2CH_2COO^-$ wherein R is hydrogen or an alkyl group (such as methyl, ethyl, propyl, butyl, or the like), —$N^+R_2CH_2CH_2COO^-$ wherein each R is, independently of the other, hydrogen or an alkyl group (such as methyl, ethyl, propyl, butyl, or the like), —$N(R)CH_2SO_3^-$ wherein R is hydrogen or an alkyl group (such as methyl, ethyl, propyl, butyl, or the like), —$N^+R_2CH_2SO_3^-$ wherein each R is, independently of the other, hydrogen or an alkyl group (such as methyl, ethyl, propyl, butyl, or the like), —$N(R)CH_2CH_2SO_3^-$ wherein R is hydrogen or an alkyl group (such as methyl, ethyl, propyl, butyl, or the like), —$N^+R_2CH_2CH_2SO_3^-$ wherein each R is, independently of the other, hydrogen or an alkyl group (such as methyl, ethyl, propyl, butyl, or the like), —$C(O)N(R)CH_2COO^-$ wherein R is hydrogen or an alkyl group (such as methyl, ethyl, propyl, butyl, or the like), —$C(O)N(R)CH_2CH_2COO^-$ wherein R is hydrogen or an alkyl group (such as methyl, ethyl, propyl, butyl, or the like), —$C(O)N(R)CH_2SO_3^-$ wherein R is hydrogen or an alkyl group (such as methyl, ethyl, propyl, butyl, or the like), —$C(O)N(R)CH_2CH_2SO_3^-$ wherein R is hydrogen or an alkyl group (such as methyl, ethyl, propyl, butyl, or the like),

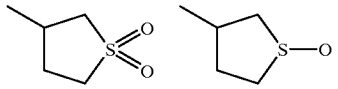

or any other suitable terminal functional group. Specific examples of suitable surfactants include ammonium laureth sulfate, commercially available as Steol CA 460 from Stepan Chemicals, Northfield, Ill, the Genapol® series of surfactants available from Hoechst Celanese Corp., Charlotte, N.C., including the 26-L series and the 24-L series, of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-98N, 24-L-3, where R is a mixture of $C_{12}H_{25}$ and $C_{14}H_{29}$ and n has an average value of about 3, 24-L-45, where R is a mixture Of $C_{12}H_{25}$ and $C_{14}H_{29}$ and n has an average value of about 6.3, 24-L-50, where R is a mixture of $C_{12}H_{25}$ and $C_{14}H_{29}$ and n has an average value of about 6.9, 24-L-60, where R is a mixture of $C_{12}H_{25}$ and $C_{14}H_{29}$ and n has an average value of about 7.2, 24-L-60N, where R is a mixture of $C_{12}H_{25}$ and $C_{14}H_{29}$ and n has an average value of about 7.0, 24-L-75, where R is a mixture of $C_{12}H_{25}$ and $C_{14}H_{29}$ and n has an average value of about 8.3, 24-L-92, and 24-L-98N, where R is a mixture of $C_{12}H_{25}$ and $C_{14}H_{29}$ and n has an average value of about 11.3, and the like. The surfactant is dissolved in a suitable solvent such as water and coated onto the recording sheet.

As illustrated schematically in FIG. 1, surfactant molecules suitable for the present invention, in a solvent such as water, assume various different configurations. For example, spherical micelles 1 form in a polar solvent when the nonpolar ends 3 of several surfactant molecules 5 cluster together, with polar ends 7 of the surfactant molecules radiating outward. At particularly high concentrations of surfactant, "inverted" micelles 9 may also form, wherein the nonpolar ends 3 radiate outward and the polar ends 7 cluster together. Under other concentration and temperature conditions, rod micelles 11 may form in a polar solvent, wherein the nonpolar ends 3 of several surfactant molecules 5 cluster together, with polar ends 7 of the surfactant molecules radiating outward, and wherein the micelle takes on a cylindrical shape. Under still other concentration and temperature conditions, the surfactant molecules in a polar solvent may assume a hexagonal liquid crystalline phase 13, wherein several rod micelles 11 pack together in a hexagonal formation. Under yet other concentration and temperature conditions, the surfactant molecules in a polar solvent may assume a lamellar liquid crystalline phase 15, in which one row surfactant molecules 5 align with polar ends 7 and nonpolar ends 3 each facing in a single direction, and wherein another row of surfactant molecules 5' forms directly adjacent to the first row, with polar ends 7' facing in the direction opposite to that taken by polar ends 7.

Figure 2:
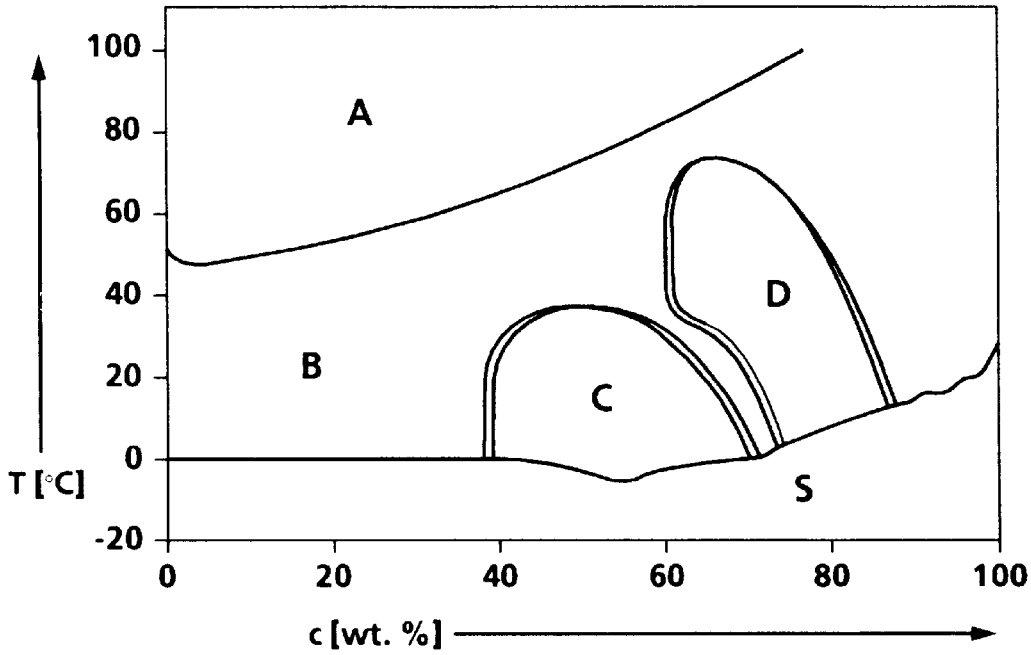
FIG. 2 represents a phase diagram indicating the phases observed at various temperatures and concentrations in an aqueous solvent of a surfactant suitable for coating the recording sheets of the present invention.

The configuration or phase assumed by the surfactant molecules in the solvent is a function of the temperature and of the concentration of surfactant molecules in the solvent. FIG. 2 represents a phase diagram indicating the phases assumed by a surfactant of the structural formula $C_{12}H_{25}$—$(OCH_2CH_2)_6OH$ in water at various temperatures in degrees Celsius and concentrations in percent by weight surfactant in the solution. As indicated, except at high concentrations, the solution is a frozen solid at 0° C. (the freezing point of the solvent), with the solid region being represented by "S". A two-phase configuration is observed at the concentrations and temperatures represented by "A", wherein micelles are present in water. A single phase containing spherical micelles and/or rod micelles occurs at the concentrations and temperatures represented by "B". A hexagonal liquid crystalline phase containing hexagonal formations of rod micelles occurs at the concentrations and temperatures represented by "C". A lamellar liquid crystalline phase containing lamellar configurations occurs at the concentrations and temperatures represented by "D". The double lines around regions "C" and "D" indicate that an indeterminate intermediate phase occurs during the transitions between these phases and the "B" phase in those areas.

Figure 3:
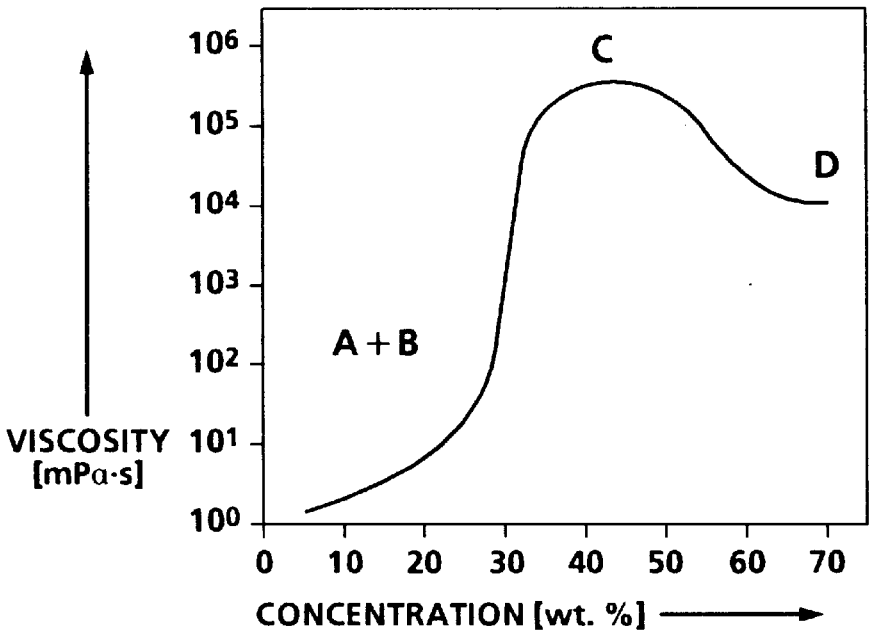
FIG. 3 represents the viscosity as a function of concentration in an aqueous solvent of a surfactant suitable for coating the recording sheets of the present invention.

The viscosity of the solution containing the surfactant molecules in a solvent varies as a function of the concentration, and also as a function of the phase in which the surfactant molecules are found at that temperature and concentration. For example, FIG. 3 represents the viscosity in milliPascal-seconds of the surfactant ammonium laureth sulfate, of the structural formula $C_{12}H_{25}$—$(OCH_2CH_2)_2OSO_3^{\ominus}NH_4^{\oplus}$, in water at varying concentrations in percent by weight of the surfactant in the solution at a fixed temperature of about 25° C. As indicated, at relatively low concentrations, the viscosity increases with increasing concentration. In these low concentration regions, spherical and rod micelles are the predominant phase (represented by "A" and "B", corresponding to regions "A" and "B" in FIG. 2). As concentration increases, viscosity peaks, and the surfactant molecules are predominantly in the hexagonal liquid crystalline phase (represented by "C", corresponding to region "C" in FIG. 2). As concentration further increases, viscosity drops as the surfactant molecules predominantly assume the lamellar liquid crystalline configuration (represented by "D", corresponding to region "D" in FIG. 2).

Accordingly, for the purposes of the present invention, the surfactant solution coated onto the recording sheet at the time of printing is in a phase such that the aqueous ink contacting the surfactant solution dilutes the surfactant solution to the extent necessary to effect a phase change that results in an increase in viscosity in the surfactant solution. For example, in a preferred embodiment of the present invention, the recording sheet substrate is coated with a solution of the surfactant in the lamellar phase. Upon application of an aqueous ink to the coating, the concentration of the surfactant is decreased by the local dilution effect of the ink drop. This decrease in concentration shifts the surfactant to the hexagonal liquid crystalline phase, and accordingly increases the viscosity of the recording sheet coating in the area of the ink droplet. While not being limited to any particular theory, it is believed to be possible that this local increase in viscosity on the recording sheet decreases drying time and inhibits printing defects such as fuzzy line edges, line growth, and intercolor bleed. Alternatively, the surfactant solution coated on the recording sheet may be at a concentration such that the surfactant is predominantly in the inverted micelles phase, so that addition of aqueous ink to the coating decreases the concentration in the area of the ink drop to an extent sufficient to effect a shift of the surfactant from the inverted micelle phase to the lamellar phase or the hexagonal phase, thus increasing the viscosity of the recording sheet in the area of the ink drop.

Figure 4:
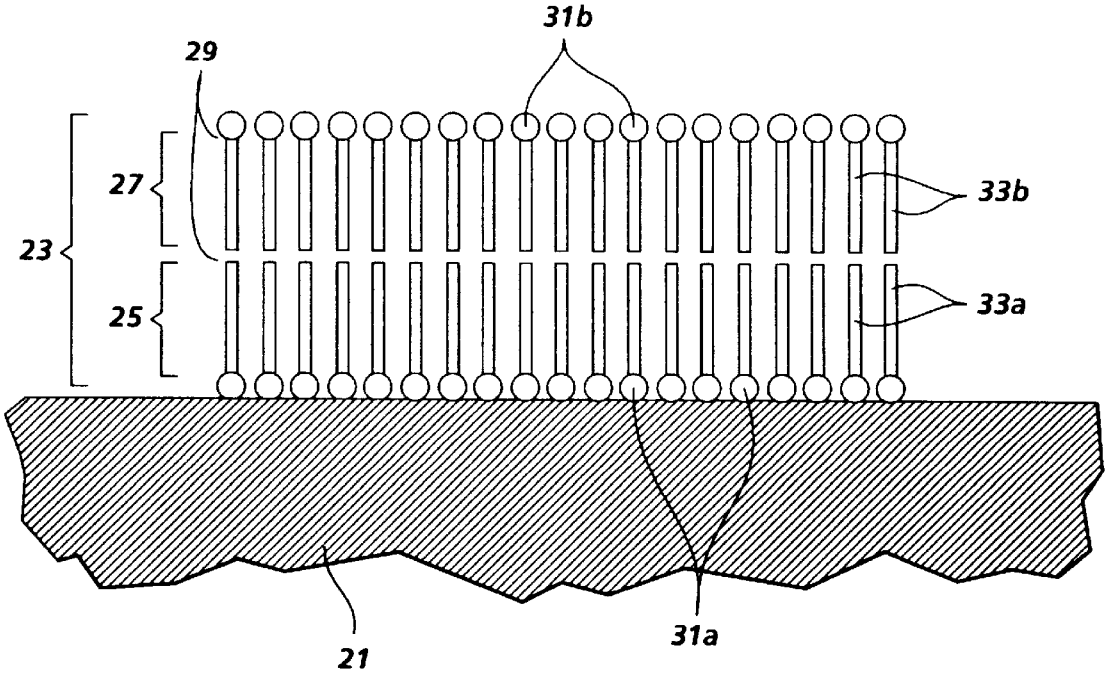
FIG. 4 illustrates schematically the orientation of surfactant molecules in the lamellar phase when coated onto a substrate in accordance with the present invention.

While not being limited to any particular theory, it is believed that recording sheets of the present invention in the embodiment wherein the surfactant molecules are in the lamellar liquid crystalline phase exhibit a structure as illustrated schematically in FIG. 4. As illustrated in cross-section in FIG. 4, substrate or base sheet 21 has situated on it a coating layer 23 comprising at least two sublayers 25 and 27 of the surfactant molecules 29, wherein polar "head" portions of the surfactant molecules 31*a* are in contact with substrate or base sheet 21 and polar "head" portions of the surfactant molecules 31*b* are situated on the surface of the coating layer 23, such that these polar groups 31*b* are available to receive the aqueous ink. Nonpolar "tail" portions of the surfactant molecules 33*a* are thus in contact with nonpolar "tail" portions of the surfactant molecules 33*b*. This situation is in contrast to recording sheets coated with surfactants not in the lamellar liquid crystalline phase or not capable of assuming a lamellar liquid crystalline phase, wherein the coated recording sheet is believed to contain a monolayer of the surfactant molecules with the polar "head" portions in contact with the substrate or base sheet and the nonpolar "tail" portions on the surface which receives the ink; it is believed that in this instance, the monolayer of surfactant molecules tends to be repellent to aqueous inks and results in beading of the ink on the recording sheet surface.

Further information regarding surfactants capable of assuming liquid crystalline phases is disclosed in, for example, *Nonionic Surfactants Physical Chemistry,* Martin J. Schick, Marcel Dekker, Inc. (New York 1987), the disclosure of which is totally incorporated herein by reference.

Figure 5:
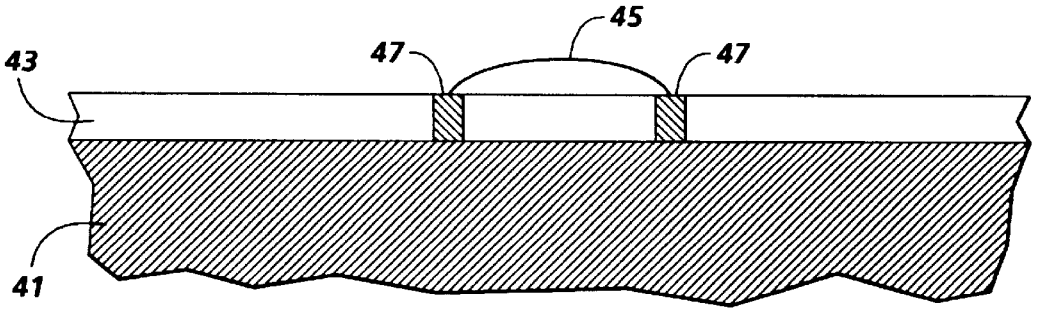
FIG. 5 illustrates schematically a recording sheet of the present invention with an ink droplet thereon.

The surfactant is applied to the substrate in any effective amount, typically from about 1 to about 100 microns, and preferably from about 4 to about 75 microns, although the thickness can be outside this range. When the substrate is nonabsorbent, such as transparency material or filled plastic, it may be preferred in some instances that the surfactant coating contain sufficient material to immobilize all of the water in the ink coating. However, it may not be necessary in some applications to immobilize all of the water in the ink. While not being limited to any particular theory, it is believed that in some instances the formation of a high viscosity barrier layer to prevent ink spread may be sufficient, while some other method is employed to dry the ink, such as air drying, application of heat, application of microwave radiation, or the like. As illustrated schematically in cross section in FIG. 5, recording sheet substrate 41 has situated thereon coating layer 43, said coating comprising a mixture of a solvent such as water and a surfactant. An ink droplet 45 has been jetted onto the coating layer 43, and in the immediate area of ink droplet 45, a relatively high viscosity barrier 47 is formed in coating layer 43 by the dilution effect of the water in the ink upon the coating composition, thereby converting the surfactant in that particular region of coating layer 43 to a relatively high viscosity phase, such as the lamellar phase or the hexagonal phase. Barrier 47 surrounds ink droplet 45 and prevents further spreading of the ink droplet, thereby inhibiting intercolor bleed, feathering, and other image defects caused by drop spreading.

Additionally, the substrate used for the recording sheets of the present invention can contain optional filler components, either in the substrate or base sheet itself or in one or more coating situated thereon. Fillers can be present in any effective amount, and if present, typically are present in amounts of from about 0.1 to about 60 percent by weight of the substrate or base sheet. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blend of calcium fluoride and silica, such as Opalex-C available from Kemira. O.Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention. In paper recording sheets of the present invention, fillers may be desired to offset any translucent character which may be imparted to the paper by the surfactant coating.

The solution containing the surfactant can be applied to either one or both surfaces of the substrate, and can be applied to the substrate by any suitable technique, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. Alternatively, drying can be at room temperature or at any other desired temperature. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. Alternatively, drying can be at room temperature or at any other desired temperature. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C. Alternatively, drying can be at room temperature or at any other desired temperature.

While in some embodiments of the present invention the recording sheet is dried subsequent to coating the substrate with the surfactant solution and prior to printing with an aqueous ink, in other embodiments, the coated recording sheet is printed upon prior to drying of the coating. While not being limited to any particular theory, it is believed that in some embodiments, the coating appears "dry" after being allowed to dry for hours or days at room temperature, although solvent molecules still remain within the surfactant coating. Thus, a "dry" coating can still contain the surfactant molecules in "solution" in the lamellar liquid crystalline phase or the inverted micelle phase. In other embodiments, the surfactant is in the desired phase in the coating material itself prior to coating, and printing takes place immediately after coating, while the recording sheet still appears "wet".

The application of the surfactant coating to the substrate can be incorporated into the printing process. In this embodiment, the surfactant coating is applied to the substrate in or near the printing apparatus by any suitable or desired process, such as by any of the above mentioned coating methods, or by incorporating the surfactant coating into an ink jet printer (continuous stream, piezoelectric, thermal, or the like) and causing the coating to be jetted onto the substrate prior to printing, or by applying the surfactant coating with an applicator such as a gravure roller, or by any other desired process. In addition, if desired, the surfactant coating can be applied to the substrate in a selective pattern, such as application only to areas of the substrate which are to be printed. In some instances, the coating composition in the concentration which is desired on the recording sheet immediately prior to printing may be too viscous to enable some application methods such as thermal ink jet printing. In these instances, it may be desirable to dilute the coating solution, incorporate it into the desired application fixture such as an ink jet printer or the like, apply the coating to the recording sheet, permit the coating to dry until it has reached the concentration desired for printing, and then print on the coating with an aqueous ink.

Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern. In another embodiment, the substrate is printed with an aqueous ink and thereafter the printed substrate is exposed to microwave radiation, thereby drying the ink on the sheet. Printing processes of this nature are disclosed in, for example, U.S. Pat. No. 5,220,346, the disclosure of which is totally incorporated herein by reference Aqueous ink compositions, such as those suitable for use in ink jet printing, particularly thermal ink jet printing, generally also contain a humectant or cosolvent. The humectant or cosolvent typically is an organic material miscible with water. Examples of suitable humectants or cosolvents include ethylene glycol, propylene glycol, diethylene glycols, glycerine, dipropylene glycols, polyethylene glycols, polypropylene glycols, amides, urea, substituted ureas, ethers, carboxylic acids, esters, alcohols, organosulfides, organosulfoxides, sulfones (such as sulfolane), alcohol derivatives, carbitol, butyl carbitol, cellusolve, ether derivatives, amino alcohols, ketones, N-methylpyrrolidinone, 2-pyrrolidinone, cyclohexylpyrrolidone, hydroxyethers, amides, sulfoxides, lactones, and other water miscible materials, as well as mixtures thereof. The humectant or cosolvent can be present in the ink composition in any effective amount. Typically, the humectant or cosolvent is present in an amount of from about 3 to about 70 percent by weight, more commonly from about 5 to about 50 percent by weight, and even more commonly from about 10 to about 30 percent by weight, although the amount can be outside these ranges. In processes of the present invention, wherein an aqueous ink is applied to a recording sheet of the present invention, the aqueous ink preferably contains no more than about 20 percent by weight of the humectant or cosolvent to reduce the possibility of the cosolvent penetrating the surfactant layer on the recording sheet and/or breaking up the lamellar structure of the surfactant layer on the recording sheet, thereby enhancing the possibility of feathering or spreading of the ink image.

Other additives can also be present in the inks. For example, one or more surfactants or wetting agents can be added to the ink. These additives may be of the cationic, anionic, or nonionic types. Suitable surfactants and wetting agents include sodium lauryl sulfate, Tamol® SN, Tamol® LG, those of the Triton® series available from Rohm and Haas Company, those of the Marasperse® series, those of the Igepal® series available from GAF Company, those of the Tergitol® series, and other commercially available surfactants. These surfactants and wetting agents are present in effective amounts, generally from 0 to about 15 percent by weight, and preferably from about 0.01 to about 8 percent by weight, although the amount can be outside of this range. In processes of the present invention, wherein an aqueous ink is applied to a recording sheet of the present invention, the aqueous ink can contain relatively large amounts (i.e., more than about 15 percent by weight) of the surfactant employed to coat the substrate or base sheet with little or no detectable detrimental effect on line sharpness.

Polymeric additives can also be added to the inks to enhance the viscosity and the stability of the ink. Water soluble polymers such as Gum Arabic, polyacrylate salts, polymethacrylate salts, polyvinyl alcohols, hydroxy propylcellulose, hydroxyethylcellulose, polyvinylpyrrolidinone, polyvinylether, starch, polysaccharides, polyethylene oxide, block copolymers of polyethylene oxide and polypropylene oxide, polyvinylpyridine, polyethyleneimine, polyhydroxyethyl ethyleneimine, polyquaternary salts, and the like are typical polymeric additives. Polymeric additives can be present in the ink of the present invention in amounts of from 0 to about 10 percent by weight, and preferably from about 0.01 to about 5 percent by weight, although the amount can be outside this range.

Other optional additives to the inks include biocides such as Dowicil 150, 200, and 75, benzoate salts, sorbate salts, and the like, present in an amount of from about 0.0001 to about 4 percent by weight, and preferably from about 0.01 to about 2.0 percent by weight, pH controlling agents such as acids or, bases, phosphate salts, carboxylates salts, sulfite salts, amine salts, and the like, present in an amount of from 0 to about 1 percent by weight and preferably from about 0.01 to about 1 percent by weight, or the like.

The ink compositions are generally of a viscosity suitable for use in thermal ink jet printing processes. Typically, the ink viscosity is no more than about 5 centipoise, and preferably is from about 1 to about 2.5 centipoise, although the viscosity can be outside this range.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Recording sheets according to the present invention were prepared by coating the wire side of Xerox 10 Series Smooth paper with an aqueous solution containing 60 percent by weight ammonium laureth sulfate surfactant (Steol CA 460, obtained from Stepan Chemicals, Northfield, Ill.). The coating was applied with a #7 Mayer rod, resulting in a coating about 11 microns thick, and the sheets were allowed to air dry for periods ranging from several hours to several days.

Thereafter an aqueous ink comprising 3 percent by weight Special Black 7984 dye (obtained from Bayer (Mobay), Rock Hill, S.C.) and 97 percent by weight water was incorporated into a drafting ruling pen and applied to the recording sheets thus prepared. In each instance the ink wetted the paper very well and feathering and spreading were essentially undetectable on the coated paper. For comparison purposes, the same ink was applied to uncoated Xerox 10 Series Smooth paper (wire side); in this instance, feathering was very apparent.

EXAMPLE II

Recording sheets according to the present invention were prepared by the method described in Example I. Thereafter, an aqueous ink comprising 3 percent by weight Special Black 7984 dye (obtained from Bayer (Mobay), Rock Hill, Ill.) 10 percent by weight ethylene glycol, and 87 percent by weight water was incorporated into a modified Diablo 635 thermal ink jet printing test fixture with Microwork 4004 cartridges containing 4 color inks, and prints were generated on the recording sheets. In each instance the ink wetted the paper very well and feathering and spreading were essentially undetectable on the coated paper. For comparison purposes, the same ink was printed onto uncoated Xerox 10 Series Smooth paper (wire side); in this instance, feathering was very apparent. In addition, intercolor bleed was considerably reduced on the papers of the present invention compared to the uncoated paper.

EXAMPLE III

Recording sheets according to the present invention were prepared by the method described in Example I with the exception that groundwood newsprint paper was substituted for the Xerox 10 Series Smooth paper. Ink was applied to the recording sheets with a pen as described in Example I and with a thermal ink jet test fixture as described in Example II. In each instance the ink wetted the paper very well and feathering and spreading were essentially undetectable on the coated paper. For comparison purposes, the same ink was printed onto uncoated groundwood newsprint paper; in this instance, feathering was very apparent. In addition, intercolor bleed was considerably reduced on the papers of the present invention compared to the uncoated paper.

Other embodiments and modifications of the present invention may occur to those skilled in the art subsequent to a review of the information presented herein; these embodiments and modifications, as well as equivalents thereof, are also included within the scope of this invention.

What is claimed is:

1. A recording sheet which comprises a substrate and an image receiving coating situated on at least one surface of the substrate, said coating comprising water and a surfactant capable of exhibiting a liquid crystalline phase in water at a temperature of about 25° C. or higher, said coating containing the water and surfactant in relative concentrations such that upon addition of water to the coating, the surfactant undergoes a phase change, thereby increasing the viscosity of the coating, wherein the recording sheet is suitable for receiving printed images, said substrate being selected from the group consisting of paper and transparent polymeric materials, said image receiving coating being suitable for receiving high quality images of an aqueous ink, said images exhibiting sharp line edges.

2. A recording sheet according to claim 1 wherein the surfactant in the coating is in a lamellar liquid crystalline phase and, upon addition of water to the coating, the surfactant undergoes a phase change to a hexagonal liquid crystalline phase.

3. A recording sheet according to claim 1 wherein the surfactant is $C_xH_{(2x+1)}(OC_2H_4)_yA$,

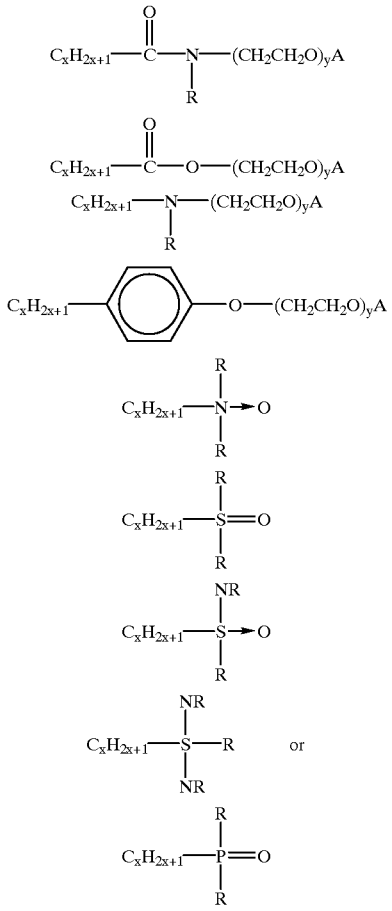

wherein each R is, independently of the others, hydrogen or an alkyl group, x is an integer of from about 8 to about 22, y is an integer of from 0 to about 14, and A is a terminal functional group.

4. A recording sheet according to claim 3 wherein x is an integer of from about 12 to about 18, y is an integer of from about 2 to about 8, and A is selected from the group consisting of —H, —OH, $—CH_3$, $—C_2H_5$, $—CH_2CH_2CH_3$, $—CH(CH_3)_2$, $—OSO_3^-$, $—OSO_2NR_2$ wherein each R is, independently of the others, hydrogen or an alkyl group, $—COO^-$, $—OPO_3^-$, $—C(O)OCH_2CH_2SO_3^-$, $—NR_3^+$ wherein each R is, independently of the others, hydrogen or an alkyl group, $—N(R)CH_2COO^-$ wherein R is hydrogen or an alkyl group, —$N^+R_2CH_2COO^-$ wherein each R is, independently of the other, hydrogen or an alkyl group, —N(R)$CH_2CH_2COO^-$ wherein R is hydrogen or an alkyl group, —$N^+R_2CH_2CH_2COO^-$ wherein each R is, independently of the other, hydrogen or an alkyl group, —N(R)$CH_2SO_3^-$ wherein R is hydrogen or an alkyl group, —$N^+R_2CH_2SO_3^-$ wherein each R is, independently of the other, hydrogen or an alkyl group, —N(R)$CH_2CH_2SO_3^-$ wherein R is hydrogen or an alkyl group, —$N^+R_2CH_2CH_2SO_3^-$ wherein each R is, independently of the other, hydrogen or an alkyl group, —C(O)N(R)$CH_2COO^-$ wherein R is hydrogen or an alkyl group, —C(O)N(R)$CH_2CH_2COO^-$ wherein R is hydrogen or an alkyl group, —C(O)N(R)$CH_2SO_3^-$ wherein R is hydrogen or an alkyl group, —C(O)N(R)$CH_2CH_2SO_3^-$ wherein R is hydrogen or an alkyl group,

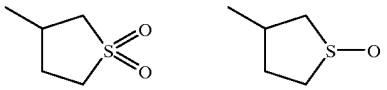

and mixtures thereof.

5. A recording sheet according to claim 1 wherein the surfactant is selected from the group consisting of those of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12.

6. A recording sheet according to claim 1 wherein the surfactant is selected from the group consisting of: (a) $C_{12}H_{25}$—$(OCH_2CH_2)_6OH$; (b) $C_{12}H_{25}$—$(OCH_2CH_2)_2OSO_3^{\ominus}$; (c) $RO(CH_2CH_2O)_nH$ where R is a mixture of $C_{12}H_{25}$ and $C_{14}H_{29}$ and n represents the number of repeating units and has an average value of about 3; (d) $RO(CH_2CH_2O)_nH$ where R is a mixture of $C_{12}H_{25}$ and $C_{14}H_{29}$ and n represents the number of repeating units and has an average value of about 6.3; (e) $RO(CH_2CH_2O)_nH$ where R is a mixture of $C_{12}H_{25}$ and $C_{14}H_{29}$ and n represents the number of repeating units and has an average value of about 6.9; (f) $RO(CH_2CH_2O)_nH$ where R is a mixture of $C_{12}H_{25}$ and $C_{14}H_{29}$ and n represents the number of repeating units and has an average value of about 7.2; (g) $RO(CH_2CH_2O)_nH$ where R is a mixture of $C_{12}H_{25}$ and $C_{14}H_{29}$ and n represents the number of repeating units and has an average value of about 7.0; (h) $RO(CH_2CH_2O)_nH$ where R is a mixture of $C_{12}H_{25}$ and $C_{14}H_{29}$ and n represents the number of repeating units and has an average value of about 8.3; (i) $RO(CH_2CH_2O)_nH$ where R is a mixture of $C_{12}H_{25}$ and $C_{14}H_{29}$ and n represents the number of repeating units and has an average value of about 11.3; and mixtures thereof.

7. A recording sheet according to claim 1 wherein the surfactant coating is present on the substrate in a thickness of from about 1 to about 100 microns.

8. A recording sheet according to claim 1 wherein the surfactant coating is present on the substrate in a thickness of from about 4 to about 75 microns.

9. A recording sheet according to claim 1 wherein the substrate is paper and the paper contains a filler.

10. In a process which comprises incorporating into an ink jet printing apparatus an aqueous ink composition and causing droplets of the ink composition to be ejected in an imagewise pattern onto a recording sheet, the improvement comprising selecting a recording sheet according to claim 1.

11. A process according to claim 10 wherein the coating containing the surfactant is allowed to dry prior to application of the ink to the recording sheet.

12. A process according to claim 10 wherein the ink is applied to the recording sheet prior to drying of the coating.

13. In a process which comprises incorporating into an ink jet printing apparatus an ink composition and causing droplets of the ink composition to be ejected in an imagewise pattern onto a recording sheet, wherein the ink is selectively heated in an imagewise pattern, thereby causing droplets of the ink to be ejected in an imagewise pattern, the improvement comprising selecting a recording sheet according to claim 1.

14. A process according to claim 13 wherein the coating containing the surfactant is allowed to dry prior to application of the ink to the recording sheet.

15. A process according to claim 13 wherein the ink is applied to the recording sheet prior to drying of the coating.

16. A process which comprises incorporating into an ink jet printing apparatus an aqueous ink composition and causing droplets of the ink composition to be ejected in an imagewise pattern onto a recording sheet according to claim 1.

17. A process according to claim 16 wherein the coating containing the surfactant is allowed to dry prior to application of the ink to the recording sheet.

18. A process according to claim 16 wherein the ink is applied to the recording sheet prior to drying of the coating.

19. A process according to claim 16 wherein the recording sheet is heated to a temperature above 25° C. when the ink is applied thereto.

20. A process according to claim 16 wherein the coating containing the surfactant is applied to the substrate via an ink jet printing process.

21. A recording sheet which comprises a substrate and a surfactant which is $C_xH_{(2x+1)}(OC_2H_4)_yA$,

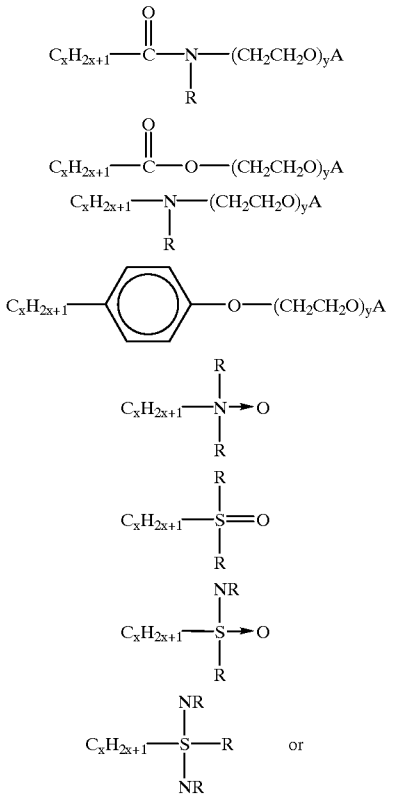

or

-continued

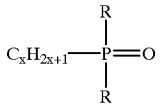

wherein each R is, independently of the others, hydrogen or an alkyl group, x is an integer of from about 8 to about 22, y is an integer of from 0 to about 14, and A is a terminal functional group, wherein the recording sheet is suitable for receiving printed images, said substrate being selected from the group consisting of paper and transparent polymeric materials, said recording sheet being suitable for receiving high quality images of an aqueous ink, said images exhibiting sharp line edges.

22. A recording sheet according to claim 21 wherein the surfactant in the coating is in a lamellar liquid crystalline phase and, upon addition of water to the coating, the surfactant undergoes a phase change to a hexagonal liquid crystalline phase.

23. A recording sheet according to claim 21 wherein the surfactant is capable of exhibiting a liquid crystalline phase in water at a temperature of about 25° C. or higher, said surfactant being present as a coating on the substrate, said coating containing water and the surfactant in relative concentrations such that upon addition of water to the coating, the surfactant undergoes a phase change, thereby increasing the viscosity of the coating.

24. A recording sheet according to claim 21 wherein x is an integer of from about 12 to about 18, y is an integer of from about 2 to about 8, and A is selected from the group consisting of —H, —OH, $—CH_3$, $—C_2H_5$, $—CH_2CH_2CH_3$, $—CH(CH_3)_2$, $—OSO_3^-$, $—OSO_2NR_2$ wherein each R is, independently of the others, hydrogen or an alkyl group, $—COO^-$, $—OPO_3^-$, $—C(O)OCH_2CH_2SO_3^-$, $—NR_3^+$ wherein each R is, independently of the others, hydrogen or an alkyl group, $—N(R)CH_2COO^-$ wherein R is hydrogen or an alkyl group, $—N^+R_2CH_2COO^-$ wherein each R is, independently of the other, hydrogen or an alkyl group, $—N(R)CH_2CH_2COO^-$ wherein R is hydrogen or an alkyl group, $—N^+R_2CH_2CH_2COO^-$ wherein each R is, independently of the other, hydrogen or an alkyl group, $—N(R)CH_2SO_3^-$ wherein R is hydrogen or an alkyl group, $—N^+R_2CH_2SO_3^-$ wherein each R is, independently of the other, hydrogen or an alkyl group, $—N(R)CH_2CH_2SO_3^-$ wherein R is hydrogen or an alkyl group, $—N^+R_2CH_2CH_2SO_3^-$ wherein each R is, independently of the other, hydrogen or an alkyl group, $—C(O)N(R)CH_2COO^-$ wherein R is hydrogen or an alkyl group, $—C(O)N(R)CH_2CH_2COO^-$ wherein R is hydrogen or an alkyl group, $—C(O)N(R)CH_2SO_3^-$ wherein R is hydrogen or an alkyl group, $—C(O)N(R)CH_2CH_2SO_3^-$ wherein R is hydrogen or an alkyl group,

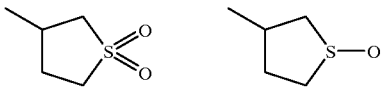

and mixtures thereof.

25. A recording sheet according to claim 21 wherein the surfactant is selected from the group consisting of those of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12.

26. A recording sheet according to claim 21 wherein the surfactant is selected from the group consisting of: (a) $C_{12}H_{25}—(OCH_2CH_2)_6OH$; (b) $C_{12}H_{25}—(OCH_2CH_2)_2OSO_3^{\ominus}$; (c) $RO(CH_2CH_2O)_nH$ where R is a mixture of $C_{12}H_{25}$ and $C_{14}H_{29}$ and n represents the number of repeating units and has an average value of about 3; (d) $RO(CH_2CH_2O)_nH$ where R is a mixture of $C_{12}H_{25}$ and $C_{14}H_{29}$ and n represents the number of repeating units and has an average value of about 6.3; (e) $RO(CH_2CH_2O)_nH$ where R is a mixture of $C_{12}H_{25}$ and $C_{14}H_{29}$ and n represents the number of repeating units and has an average value of about 6.9; (f) $RO(CH_2CH_2O)_nH$ where R is a mixture Of $C_{12}H_{25}$ and $C_{14}H_{29}$ and n represents the number of repeating units and has an average value of about 7.2; (g) $RO(CH_2CH_2O)_nH$ where R is a mixture of $C_{12}H_{25}$ and $C_{14}H_{29}$ and n represents the number of repeating units and has an average value of about 7.0; (h) $RO(CH_2CH_2O)_nH$ where R is a mixture of $C_{12}H_{25}$ and $C_{14}H_{29}$ and n represents the number of repeating units and has an average value of about 8.3; (i) $RO(CH_2CH_2O)_nH$ where R is a mixture of $C_{12}H_{25}$ and $C_{14}H_{29}$ and n represents the number of repeating units and has an average value of about 11.3; and mixtures thereof.

27. A recording sheet according to claim 21 wherein the surfactant is present on the substrate in a thickness of from about 1 to about 100 microns.

28. A recording sheet according to claim 21 wherein the surfactant is present on the substrate in a thickness of from about 4 to about 75 microns.

29. A recording sheet according to claim 21 wherein the substrate is paper and the paper contains a filler.

30. A recording sheet which comprises a substrate and an image receiving coating situated on at least one surface of the substrate, said coating comprising a surfactant, said surfactant being in a lamellar liquid crystalline phase, wherein the recording sheet is suitable for receiving printed images, said substrate being selected from the group consisting of paper and transparent polymeric materials, said image receiving coating being suitable for receiving high quality images of an aqueous ink, said images exhibiting sharp line edges.

31. A recording sheet according to claim 30 wherein upon addition of water to the surfactant, the surfactant undergoes a phase change to a hexagonal liquid crystalline phase.

32. A recording sheet according to claim 30 wherein the surfactant is $C_xH_{(2x+1)}(OC_2H_4)_yA$,

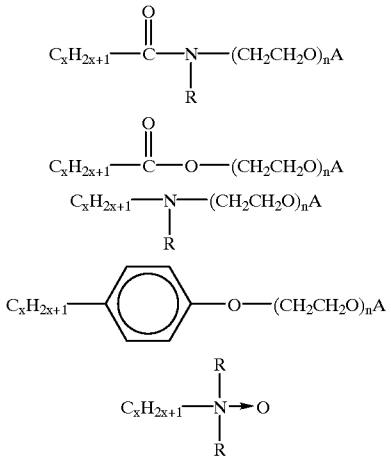

-continued

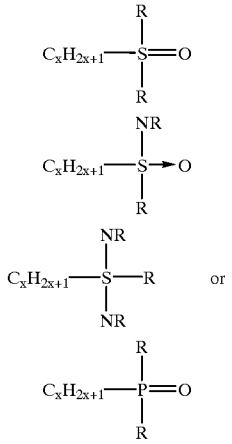

wherein each R is, independently of the others, hydrogen or an alkyl group, x is an integer of from about 8 to about 22, y is an integer of from 0 to about 14, and A is a terminal functional group.

33. A recording sheet according to claim 32 wherein x is an integer of from about 12 to about 18, y is an integer of from about 2 to about 8, and A is selected from the group consisting of —H, —OH, $—CH_3$, $—C_2H_5$, $—CH_2CH_2CH_3$, $—CH(CH_3)_2$, $—OSO_3^-$, $—OSO_2NR_2$ wherein each R is, independently of the others, hydrogen or an alkyl group, $—COO^-$, $—OPO_3^-$, $—C(O)OCH_2CH_2SO_3^-$, $—NR_3^+$ wherein each R is, independently of the others, hydrogen or an alkyl group, $—N(R)CH_2COO^-$ wherein R is hydrogen or an alkyl group, $—N^+R_2CH_2COO^-$ wherein each R is, independently of the other, hydrogen or an alkyl group, $—N(R)CH_2CH_2COO^-$ wherein R is hydrogen or an alkyl group, $—N^+R_2CH_2CH_2COO^-$ wherein each R is, independently of the other, hydrogen or an alkyl group, $—N(R)CH_2SO_3^-$ wherein R is hydrogen or an alkyl group, $—N^+R_2CH_2SO_3^-$ wherein each R is, independently of the other, hydrogen or an alkyl group, $—N(R)CH_2CH_2SO_3^-$ wherein R is hydrogen or an alkyl group, $—N^+R_2CH_2CH_2SO_3^-$ wherein each R is, independently of the other, hydrogen or an alkyl group, $—C(O)N(R)CH_2COO^-$ wherein R is hydrogen or an alkyl group, $—C(O)N(R)CH_2CH_2COO^-$ wherein R is hydrogen or an alkyl group, $—C(O)N(R)CH_2SO_3^-$ wherein R is hydrogen or an alkyl group, $—C(O)N(R)CH_2CH_2SO_3^-$ wherein R is hydrogen or an alkyl group,

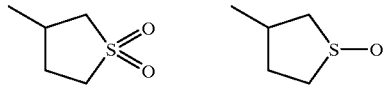

and mixtures thereof.

34. A recording sheet according to claim 30 wherein the surfactant is selected from the group consisting of those of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12.

35. A recording sheet according to claim 30 wherein the surfactant is selected from the group consisting of: (a) $C_{12}H_{25}—(OCH_2CH_2)_6OH$; (b) $C_{12}H_{25}—(OCH_2CH_2)_2OSO_3^{\ominus}$; (c) $RO(CH_2CH_2O)_nH$ where R is a mixture of $C_{12}H_{25}$ and $C_{14}H_{29}$ and n represents the number of repeating units and has an average value of about 3; (d) $RO(CH_2CH_2O)_nH$ where R is a mixture of $C_{12}H_{25}$ and $C_{14}H_{29}$ and n represents the number of repeating units and has an average value of about 6.3; (e) $RO(CH_2CH_2O)_nH$ where R is a mixture of $C_{12}H_{25}$ and $C_{14}H_{29}$ and n represents the number of repeating units and has an average value of about 6.9; (f) $RO(CH_2CH_2O)_nH$ where R is a mixture of $C_{12}H_{25}$ and $C_{14}H_{29}$ and n represents the number of repeating units and has an average value of about 7.2; (g) $RO(CH_2CH_2O)_nH$ where R is a mixture of $C_{12}H_{25}$ and $C_{14}H_{29}$ and n represents the number of repeating units and has an average value of about 7.0; (h) $RO(CH_2CH_2O)_nH$ where R is a mixture of $C_{12}H_{25}$ and $C_{14}H_{29}$ and n represents the number of repeating units and has an average value of about 8.3; (i) $RO(CH_2CH_2O)_nH$ where R is a mixture of $C_{12}H_{25}$ and $C_{14}H_{29}$ and n represents the number of repeating units and has an average value of about 11.3; and mixtures thereof.

36. A recording sheet according to claim 30 wherein the surfactant coating is present on the substrate in a thickness of from about 1 to about 100 microns.

37. A recording sheet according to claim 30 wherein the surfactant coating is present on the substrate in a thickness of from about 4to about 75 microns.

38. A recording sheet according to claim 30 wherein the substrate is paper and the paper contains a filler.

* * * * *